US011987911B2

(12) United States Patent
Corain

(10) Patent No.: US 11,987,911 B2
(45) Date of Patent: May 21, 2024

(54) WEFT THREADS SAVING DEVICE FOR WEAVING MACHINES

(71) Applicant: SANTEX RIMAR GROUP S.R.L., Vicenza (IT)

(72) Inventor: Luciano Corain, Vicenza (IT)

(73) Assignee: SANTEX RIMAR GROUP S.R.L., Vicenza (IT)

( * ) Notice: Subject to any disclaimer, the term of this patent is extended or adjusted under 35 U.S.C. 154(b) by 214 days.

(21) Appl. No.: 17/619,690

(22) PCT Filed: Aug. 7, 2020

(86) PCT No.: PCT/IB2020/057468
§ 371 (c)(1),
(2) Date: Dec. 16, 2021

(87) PCT Pub. No.: WO2021/038344
PCT Pub. Date: Mar. 4, 2021

(65) Prior Publication Data

US 2022/0307165 A1 Sep. 29, 2022

(30) Foreign Application Priority Data

Aug. 23, 2019 (IT) ..... 102019000014982

(51) Int. Cl.
*D03D 49/70* (2006.01)
*D03D 47/12* (2006.01)

(52) U.S. Cl.
CPC ..... *D03D 49/70* (2013.01); *D03D 47/125* (2013.01)

(58) Field of Classification Search
CPC ..... D03D 49/70; D03D 47/125; D03D 45/50; D03D 47/36; D03D 47/38
See application file for complete search history.

(56) References Cited

U.S. PATENT DOCUMENTS 972,118 A * 10/1910 Martinek ..... D03D 49/70 139/266
1,291,059 A * 1/1919 Marshall et al. ..... D03D 49/70 139/264
1,440,981 A * 1/1923 Gove ..... D03D 45/20 139/264

(Continued)

FOREIGN PATENT DOCUMENTS

BE 642341 7/1964
GB 258992 10/1926

(Continued)

OTHER PUBLICATIONS

Chinese Office Action, issued in 202080045302.4, dated Jan. 30, 2023.

(Continued)

*Primary Examiner* — Robert H Muromoto, Jr.
(74) *Attorney, Agent, or Firm* — Ferguson Case Orr Paterson

(57) ABSTRACT

A weft threads saving device for shuttle-less weaving machines includes a comb (2), a temple (3), a guiding plane (6), a fixed blade (4), a movable blade (5) of a shear (17), a fabric winding cylinder (8) and a suction system (7) connected both to the guiding plane (6) and to the fixed blade (4) of the shear (17).

18 Claims, 6 Drawing Sheets

(56) References Cited

Figure 1:
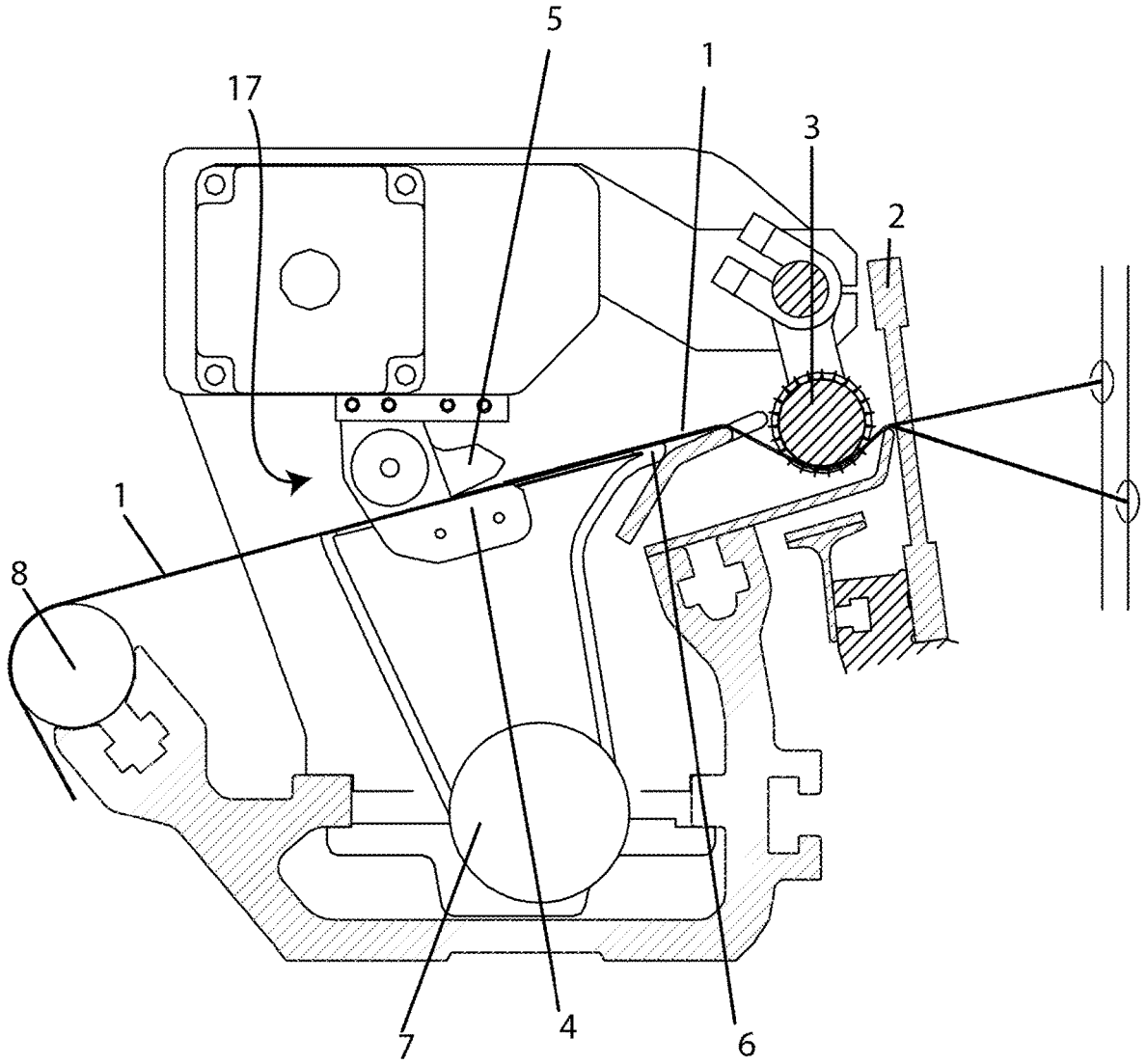

U.S. PATENT DOCUMENTS 1,609,183 A * 11/1926 Offroy ..... D03J 1/002 15/40
1,647,731 A * 11/1927 Holmes ..... D03D 49/70 139/263
1,733,191 A * 10/1929 Gordon ..... D03D 49/70 139/263
1,830,271 A * 11/1931 Gordon ..... D03D 49/70 139/302
1,835,324 A * 12/1931 Payne ..... D03D 49/70 139/303
1,881,920 A * 10/1932 Payne ..... D03D 49/70 139/263
2,080,784 A 5/1937 Pool
2,173,987 A * 9/1939 Turner ..... D03D 49/70 139/267
2,199,296 A * 4/1940 Turner ..... D03D 45/50 139/256 A
2,199,353 A * 4/1940 Turner ..... D03D 45/50 139/256 A
2,207,089 A * 7/1940 Darwin ..... D03D 45/50 139/256 A
2,219,768 A * 10/1940 Darwin ..... D03D 45/50 139/256 A
2,224,594 A * 12/1940 Cederlund ..... D03D 45/50 139/256 A
2,226,267 A * 12/1940 Turner ..... D03D 49/70 139/260
2,326,863 A * 8/1943 Jennings ..... D03D 45/50 139/264
2,336,255 A * 12/1943 Langdon ..... D03D 45/50 139/256 A
2,365,844 A * 12/1944 Santon ..... D03D 45/50 139/247
2,387,289 A * 10/1945 Payne ..... D03D 45/50 74/399
2,445,129 A * 7/1948 Turner ..... D03D 45/50 139/256 A
2,448,161 A * 8/1948 Turner ..... D03D 45/50 139/256 A
2,457,952 A * 1/1949 Turner ..... D03D 45/50 139/264
2,696,224 A * 12/1954 Holcombe ..... D03D 49/70 139/267
2,868,235 A * 1/1959 Cederlund ..... D03D 49/70 139/303
2,897,847 A * 8/1959 Cederlund ..... D03D 45/50 139/256 R
3,083,738 A * 4/1963 Pfarrwaller ..... D03D 47/48 139/302
3,127,914 A * 4/1964 Bulcock ..... D03D 49/70 139/303
3,461,920 A * 8/1969 Toemon ..... D03D 49/70 139/302
4,054,159 A * 10/1977 Juillard ..... D03D 47/00 139/450
4,160,468 A * 7/1979 Camprubi ..... D03D 47/38 139/453
4,417,606 A * 11/1983 Corain ..... D03D 47/236 139/448
4,498,504 A 2/1985 Allen
4,505,304 A * 3/1985 Zust ..... D03D 49/70 83/658
4,544,001 A * 10/1985 Moessinger ..... D03D 47/34 139/452
4,600,039 A * 7/1986 Corain ..... D03D 47/48 139/434
4,884,598 A * 12/1989 Corain ..... D03D 51/34 139/436
5,246,038 A * 9/1993 Corain ..... D03D 47/48 139/434
5,762,111 A 6/1998 Frischknecht
5,996,647 A * 12/1999 Krumm ..... D03C 7/04 139/54
6,006,795 A * 12/1999 Corain ..... B65H 54/2833 139/438
6,026,864 A * 2/2000 Corain ..... D03D 47/38 139/453
6,026,865 A * 2/2000 Krumm ..... D03D 47/34 139/453
6,039,086 A * 3/2000 Dornier ..... D03C 7/04 139/54
6,058,980 A * 5/2000 Scari ..... D03D 47/40 139/194
6,431,223 B1 * 8/2002 Corain ..... D03D 47/233 139/448
6,938,648 B2 * 9/2005 Herrlein ..... D03D 47/125 139/116.1
10,472,745 B2 * 11/2019 Gielen ..... D03D 49/70
2016/0222555 A1 * 8/2016 Tanaka ..... D03D 47/308
2021/0207300 A1 * 7/2021 Corain ..... D03D 47/125
2022/0307165 A1 * 9/2022 Corain ..... D03D 49/70

FOREIGN PATENT DOCUMENTS

JP S6253444 3/1987
TW 530103 5/2003

OTHER PUBLICATIONS

International Search Report, issued in PCT/IB2020/057468, dated Nov. 18, 2020.
Written Opinion, issued in PCT/IB2020/057468, dated Nov. 18, 2020.

* cited by examiner

Fig. 2a
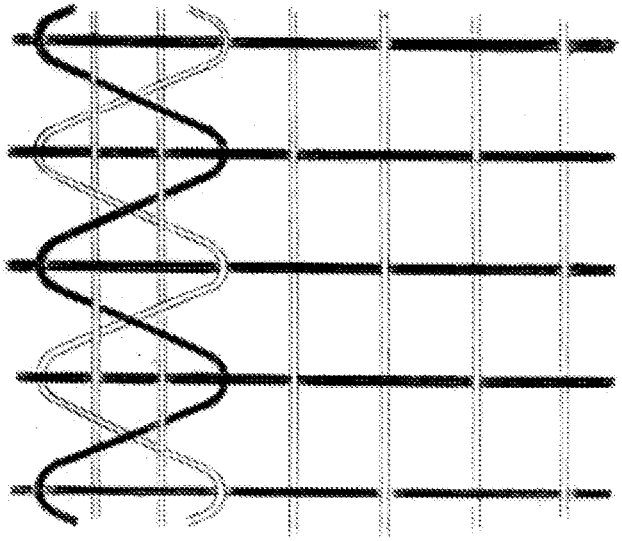
Fig. 2b
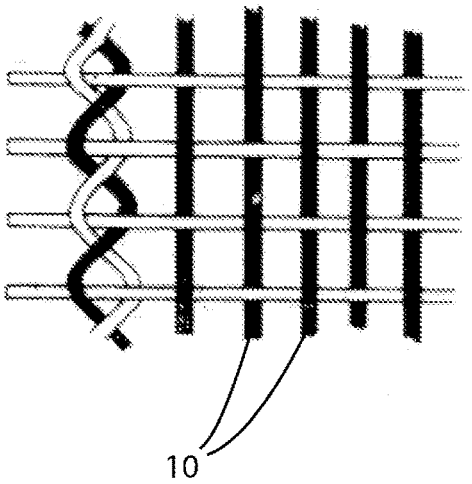
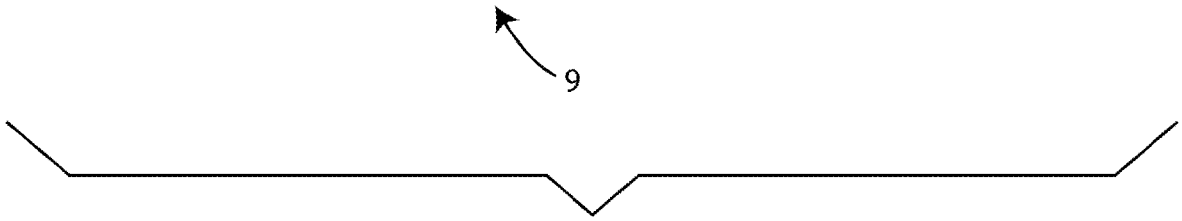
Fig. 2

WEFT THREADS SAVING DEVICE FOR WEAVING MACHINES

The present invention relates to a weft threads saving device for weaving machines or looms; the aforesaid device allows to eliminate split selvages through specific controls and interventions on the side edges of the fabric.

Therefore, the present invention is placed in the field of devices adapted to the production of fabrics with shuttle-less weaving machines or looms, in particular rapier machines.

For various and different limitations, e.g. of physical and structural type, the construction of weft threads saving devices in weaving machines capable of ensuring fabric productivity, quality control, versatility without compromising the ease of use by the operator, is currently a relevant issue because the aforesaid devices have so far proved to be difficult to implement.

The weaving machine technology can be divided into shuttle looms and shuttle-less weaving machines.

In shuttle looms, the side edges of the produced fabric are bound by the weft threads which are inserted and re-enter into successive warp openings, seamlessly for new insertions.

In shuttle-less weaving machines, the produced fabrics have the side edges with the protruding cut end of each inserted weft. For this reason, the wefts must be stabilized through a bond with dedicated warp threads, which are interlaced according to specific configurations.

The binding generally used for the selvages of shuttle-less looms is of the two-thread leno type, which is universally combined with the use of split selvages, which subsequently cut and eliminated, with the respective discarding of yarn.

Despite this waste due to the discarding of yarn, split selvages continue to be used because they ensure uniformity of the weft/warp interlacing structure between the center and sides of the fabric.

They also allow weaving with a large number of weft colors without presentation selection limits with the so-called "pick-at-will" management, and simplify the variation of the comb breadth of the fabric upon change of item, allowing a regular finishing of the side edges of the fabric.

The problem underlying the present invention is that of optimizing the weaving process in a shuttle-less loom, eliminating the split selvages which for various and different reasons described above increase the waste of yarn, but continue to ensure optimal finishing of the fabric.

Several devices have been studied to eliminate the problems related to split selvages. The known solutions were mainly aimed at the problems of the weft entry side into the warp. The entry side is characterized by the presence of a color selector for the presentation of the wefts coming from the reels to the rapiers, which lead to a vertex located at the beginning of the fabric formation line.

For controlling and managing this function, sets of rapiers have generally been studied, in number equal to the number of wefts at work, each of which is responsible for managing the assigned thread, to withhold it, present it for insertion into the warp and then pick it back up at the end of the insertion cycle.

Despite the weft saving advantages described above, these devices complicate the management of presented wefts, making the loom more complex to manage, e.g. when changing items and the weaving breadth, as well as limiting the number of colors in weft that can be used for working.

As far as the warp exit side of the weft is concerned, the problems mainly concern the tension that the weft must maintain after the comb beat to ensure the stabilization of a uniform weft/weft interlacing between the center and sides of the fabric and to avoid random weft tails re-entering the fabric.

In any event, a device for shuttle-less looms, which allows the elimination of split selvages, with features similar to those described in detail below, is not currently on the market.

Therefore, in the scope of the aforesaid requirements, it is the main object of the present invention to provide a weft threads saving device in shuttle-less weaving machines which allows the elimination of split selvages.

Advantageously, the present device is based on the control of the weft thread tension at the ends of the fabric edges and the control of the arrangement of the weft portions protruding from the fabric.

The aforesaid device prepares the weft tails for cutting with the use of mechanical and pneumatic elements and with specific side bindings which are more effective than the aforesaid leno bindings, and characterized by simple and intuitive management, which is part of the weaver's usual know-how.

The first element of this process is a weft cut at the entry into the warp with three-dimensional adjustment of the cutting position, to optimize the length of the wefts protruding from the fabric.

The side bindings of the edges of the fabric can be made with four threads crossing with each other or, alternatively, when allowed by the fabric, with two helical interlaced threads and variable timing of the pitch crossing with respect to the warp.

It is then necessary to ensure controlling the arrangement of the wefts protruding from the edges of the fabric at the exit of the temple, with the use of guiding elements towards a shear which cuts the weft protrusions and the respective recovery nozzle.

It is a further object of the present invention to manage the colors in the weft through a standard selector with 8 or more pick-at-will colors, as would be the case with split selvages.

Furthermore, it is the object of the present invention to allow breadth variations of the fabric on both sides thereof while maintaining all the functional standard details of the textile cycle.

It is the object of the invention to ensure a versatility which allows the use of all types of weft threads and the possible recycling of the recovered excess tails, thus eliminating the management of split selvage beams and the related tension controls, maintaining the use of an entire advanced breast beam at full weaving breadth, reducing the rapier stroke and ensuring better production performance of the machine.

Therefore, the present invention relates to a device for shuttle-less weaving machines which allows weft saving with the elimination of split selvages, through the use and coordination of the component elements, indicated above, related to a weft cut such as to optimize the portions protruding from the fabric and a specific side binding of the edges of the fabric. On the sides of the fabric, there are devices which are arranged at the exit from the temple to ensure the preparation of the wefts, on a guiding path which consists of a fixed plane which continues, in the final part, on a fixed blade parallel to the path of the fabric consisting of the blade of a shear.

The aforesaid shear cuts the weft tails which are sucked by a nozzle and then recovered. The device ensures regularity of the weft/warp interlacing and uniformity between the center and selvages of the fabric similar to what would be obtained with split selvages. This is also achieved by bindings at the ends of the fabric made using dedicated warp threads and specific interlacing as shown in the figures below, to form a stable edge of the finished fabric.

Figure 3:
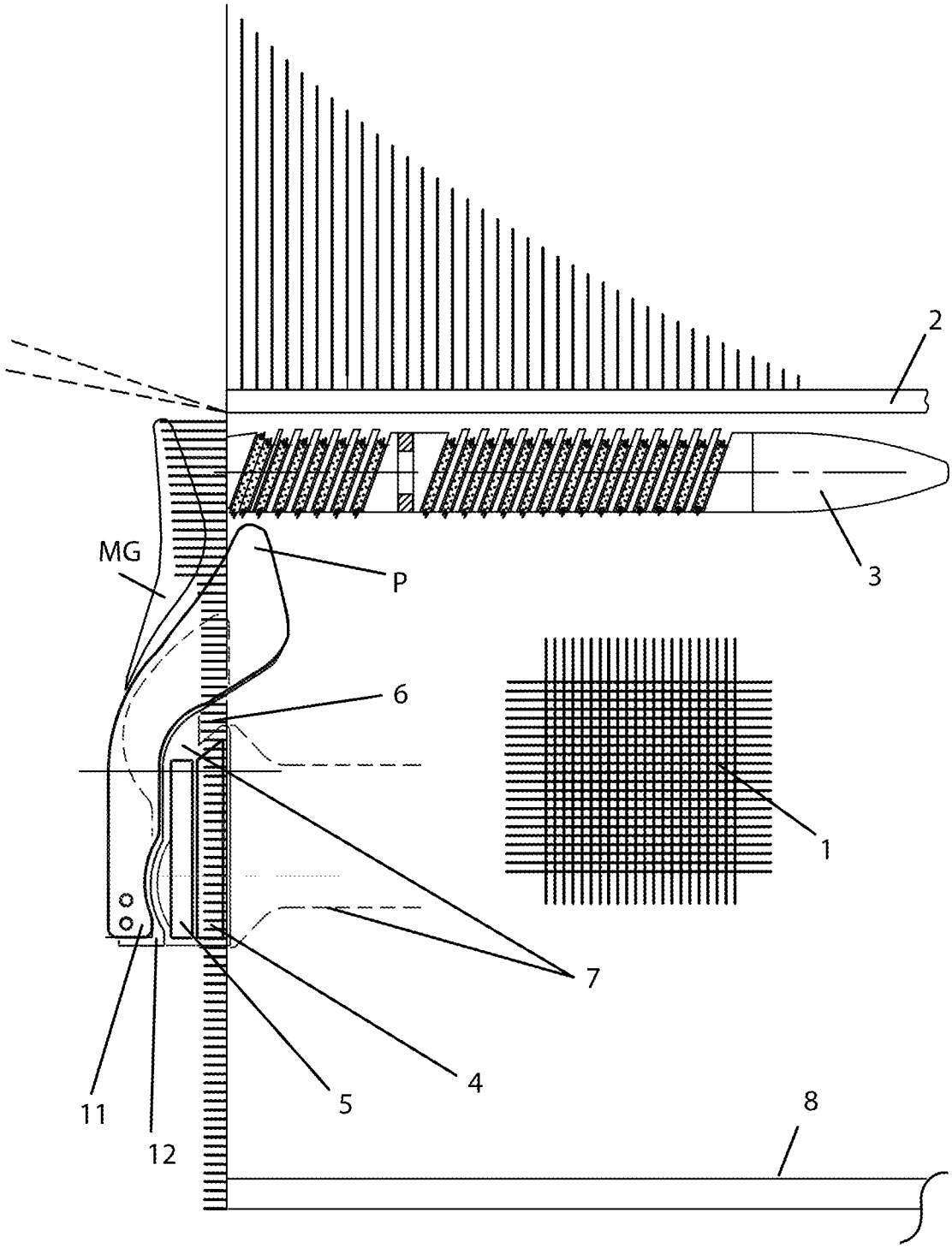
Figure 4:
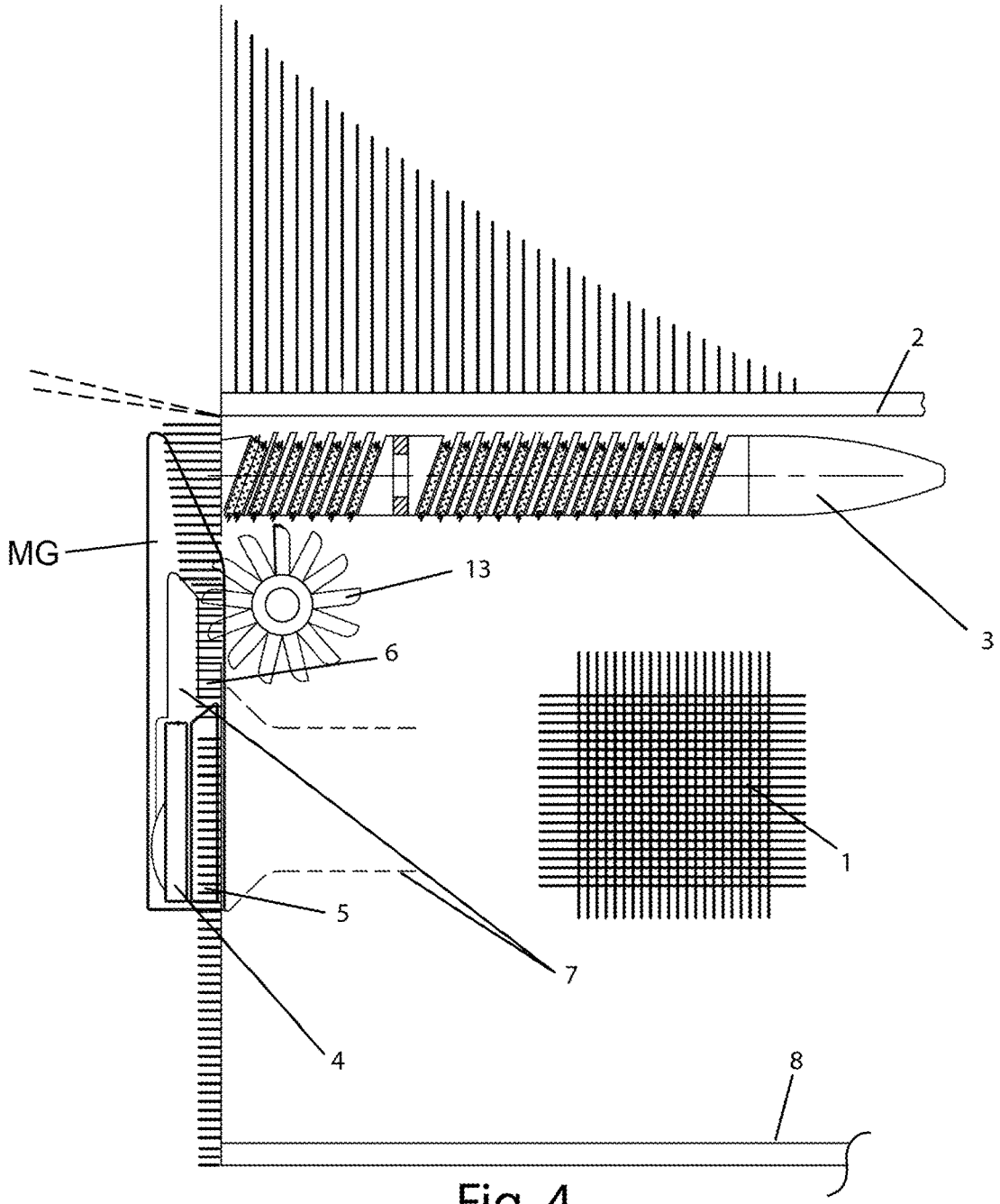
Figure 4A:
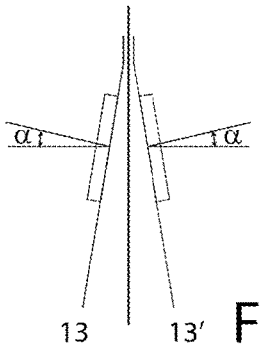
Figure 5:
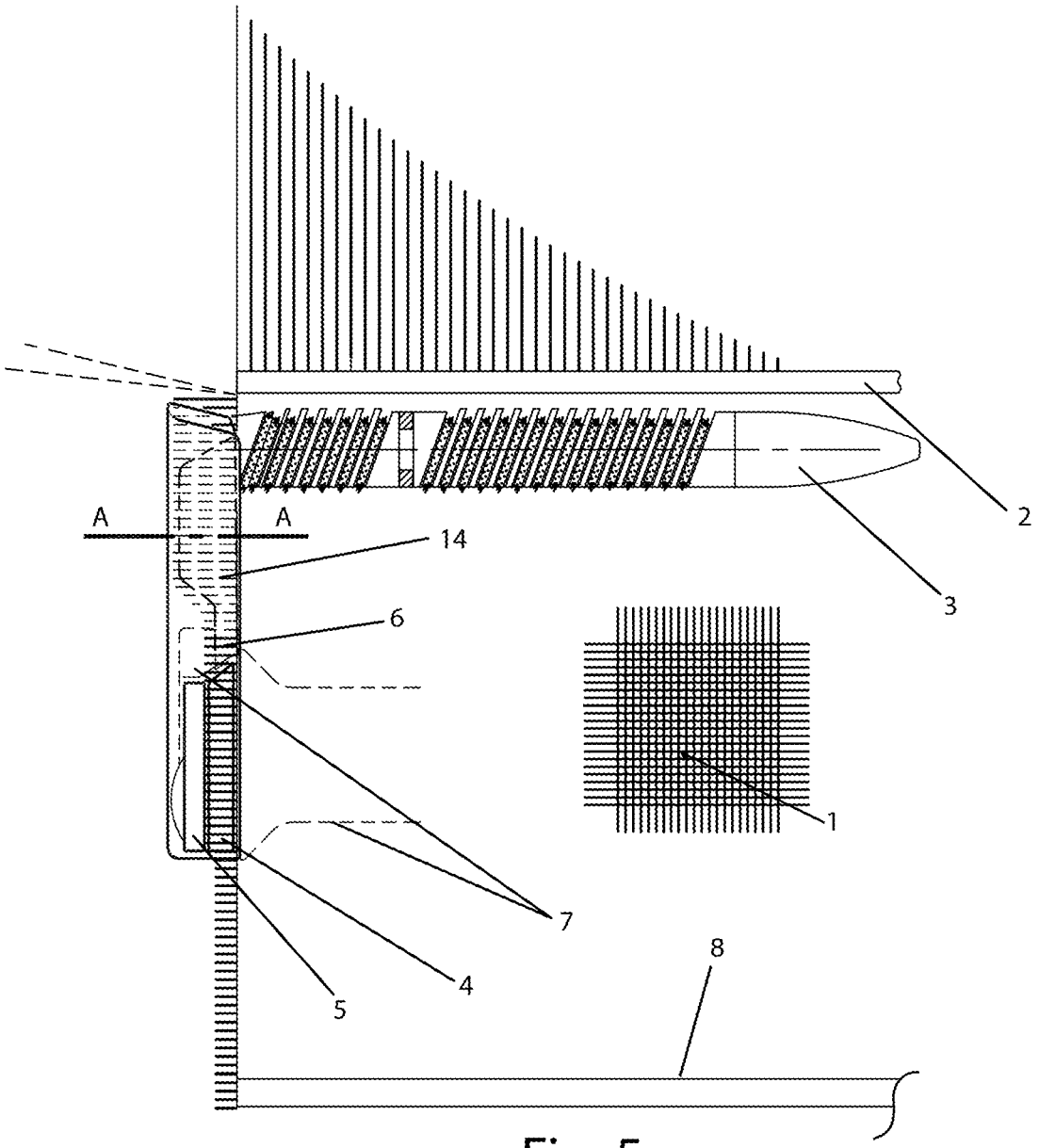
Figure 5A:
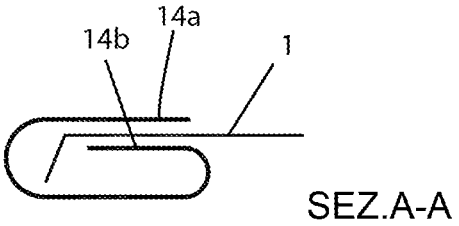
Figure 6:
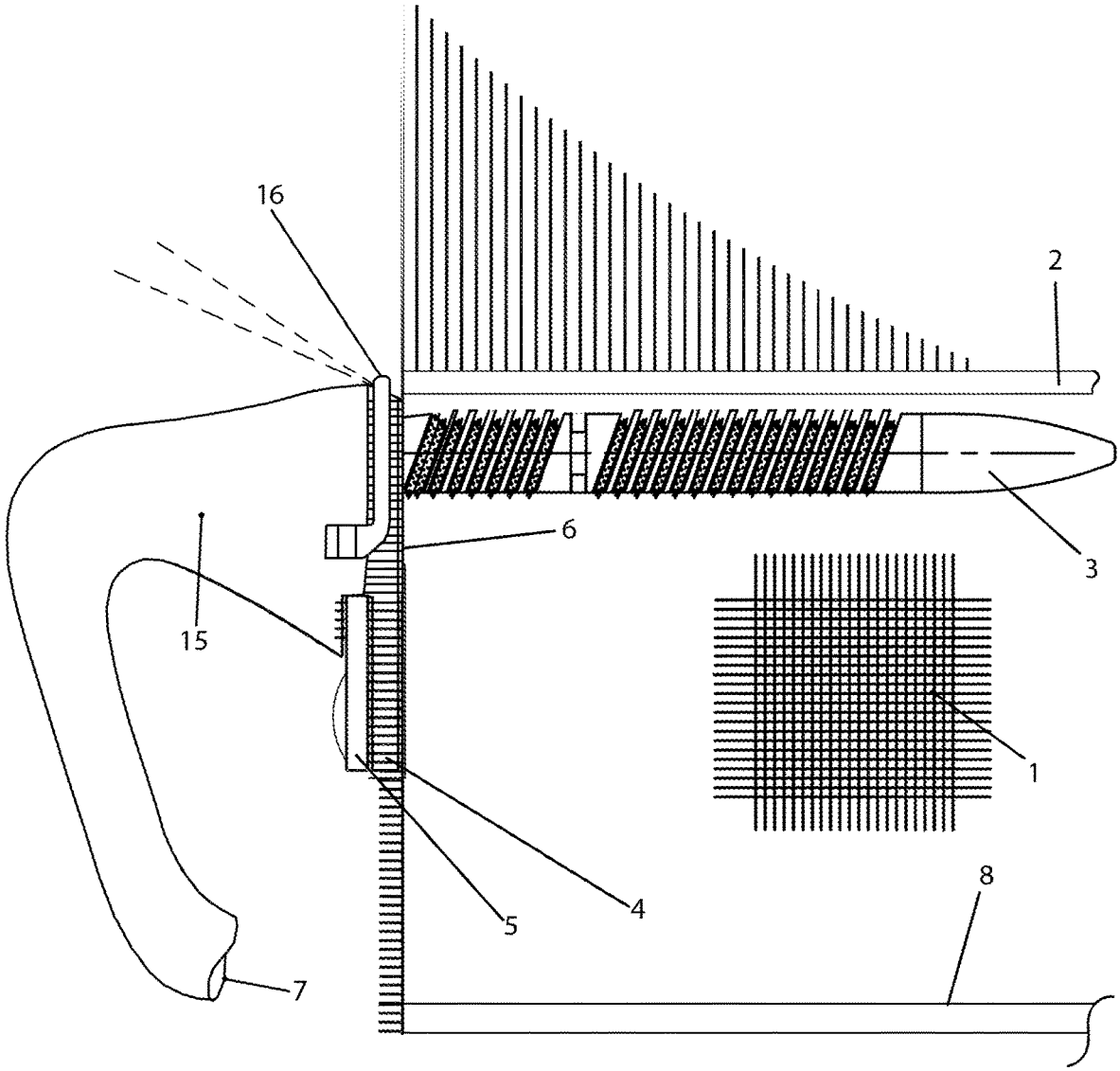

These and other objects are achieved by a weft saving device for weaving machine according to the invention, described in greater detail hereinafter in the present description of a preferred, but not exclusive embodiment thereof, provided by way of non-limiting example in the accompanying drawings, in which:

FIG. 1 diagrammatically shows a partial and partially sectional view of a portion of the loom in which the device according to the present invention is illustrated;

FIG. 2 diagrammatically shows a front view of two thread interlacing types; in particular, FIG. 2*a* diagrammatically shows an interlacing with four crossed threads, while FIG. 2*b* diagrammatically shows a two-thread helical interlacing;

FIG. 3 diagrammatically shows a view from the top of a first embodiment of the device for weaving machine according to the present invention;

FIG. 4 relates to a top view of a second embodiment of the device for weaving machine according to the present invention;

FIG. 4*a* is an inclination angle view of an element, according to the second embodiment of the device for weaving machine according to the present invention;

FIG. 5 relates to a top view of a third embodiment of the device for weaving machine according to the present invention;

FIG. 5*a* is a section view taken along line A-A in FIG. 5;

FIG. 6 relates to a top view of a fourth embodiment of the device for weaving machine according to the present invention.

With reference to the aforesaid figures, the weft saving device for weaving machines of the present invention, as shown in FIG. 1, is a structure placed between a comb 2 and a temple 3 for the formation of the fabric, placed on one side, and a fabric winding cylinder 8, placed on the other side, downstream from the comb 2 and temple 3.

In the portion between the temple 3 and the cylinder 8, the edge of the fabric slides on a fixed guiding plane 6 placed at the exit of the temple 3 in the direction of the cylinder 8 and on a subsequent guiding section consisting of the lower blade 4, in a fixed position parallel to the fabric, of a shear 17. The second movable blade 5, e.g. of the oscillating type, of the shear 17 cuts the weft protrusions to the desired length.

Several devices, alternatively of pneumatic and/or mechanical type, which are suitable for controlling the correct tension of the weft tails and the preparation to cut are positioned at the exit of the temple 3 and before the blades 4 and 5 of shear 17. The weft tails are prepared to cut the excess parts by a suction system 7 and then cut to a predetermined length from the edge of the fabric 1.

The suction system is in position under the blades 4 and 5 and is connected to the fixed guiding table 6 and the fixed blade 4 of the shear 17.

The edge of fabric 1 is stabilized with specific warp and weft interlacing after each beat of the comb 2. FIG. 2*a* shows the interlacing 9 with four crossed threads which the side binding of the inserted wefts ensures the necessary tension for the regularity of the weft/weft interlacing between the center and the sides of the fabric; such interlacing 9 may be provided with the use of the device according to the invention and allows to eliminate the draw of the split selvages. Alternatively, if allowed by the fabric, a similar function may be provided by a two-thread helical interlacing 10, as shown in FIG. 2*b*.

The cutting method of the weft tails is illustrated in figures from 3 to 6 in alternative versions, e.g. such as mechanical, pneumatic, and/or mixed versions.

FIG. 3 shows a first embodiment of the present invention with a solution for controlling the weft tails comprising two opposing strips 11, 12, e.g. metallic and elastic, which are placed in contact on both sides of the fabric 1 and with the front part P near the temple 3.

The distance between the strips 11, 12 increases progressively along the cutting direction of the shear 17 and the profile of the aforesaid strips 11, 12, between which the edge of fabric 1 slides, pushes the weft tails outwards, which are first grouped towards a guiding edge MG, while the fabric 1 slides towards the cylinder 8.

In the spaced portion of the strips 11, 12 the weft tails are sucked by the suction system 7 and brought close to the guiding plane 6 under and the fixed blade 4 until they are cut by the movable blade 5 of the shear 17.

FIG. 4 shows a further embodiment of the invention, in which the device comprises a very thin and flexible metal disk 13, which is carved in a radial pattern, placed in contact with fabric 1 on an arc of its contour; the disk 13 is set in rotation by the feeding of the fabric 1 and by the radial shape and inclination a of its rotation axis (FIG. 4*a*).

The metal disk 13 is elastically opposed to a second disk 13', under the fabric 1 with a specular arrangement to that of the disk above.

The two disks 13, 13', by rotating pushed by the feeding of the fabric 1, arrange the weft tails which slide on the guiding table 6 and on the fixed blade 4 of the shear 17 as a fringe towards the outside of the fabric edge, in a position under the fabric 1, to be prepared for the cutting of the shear 17.

FIG. 5 shows a further embodiment of the device according to the present invention, comprising a suction nozzle 15 with flaps wound and overlapped as indicated in section A-A in FIG. 5*a*, with the edge of the fabric 1 which slides longitudinally in contact between the upper flap 14*a* and the lower flap 14*b*, while the compartment underneath has the function of sucking the weft tails for cutting with the shear 17 and preparing them on the guiding plane 6 and the fixed blade 4.

FIG. 6 shows another embodiment of the device according to the invention, wherein a suction nozzle 15 is used suitably arranged to keep the weft tails parallel to each other and in a position perpendicular to the edge of the fabric 1 until the exit from temple 3; the functional criteria are the same as described in the previous cases.

In this case, at the exit side of the weft from the warp mouth, the tails released by an exit rapier are recovered, with a part of the suction nozzle 15, which, placed beyond the temple 3 and with a suitable shape, forms the continuous guiding plane 6 with the fixed blade 4 of the shear 17; the movable blade 5 of the shear 17 then cuts the weft tails sucked by the nozzle 15.

The suction nozzle 15 can have an airflow direction close to the weft direction. The weft tails advance with the fabric keeps the air direction trim until cutting and suction.

In other embodiments of the present invention, the device in FIG. 6 also makes advantageous use of an elastic gripping element 16 on the guiding plane 6 of the weft tails advancing with the fabric 1. The gripping element 16 can be used when an additional thread tension is required before cutting with the shear 17.

The technical features of the weft threads saving device for weaving machines according to the present invention are apparent from the description above, as are its advantages, such as:

- weft color management with standard pick-at-will selector with eight or more colors, as with split selvages;
- use of all types of weft threads and possible recycling of recovered tails;
- variations in the breadth of the fabric on both sides thereof, while maintaining all the functional details of the textile cycle;
- possibility of using standard temples and combs;
- full advanced breast beam in full weaving breadth;
- elimination of the management of split selvages and related tension controls;
- reduction of the rapier travel ensuring better productive performance of the machine;
- limited cost of production, as compared to traditional solutions, in relation to the achieved benefits.

The invention thus described and disclosed herein is susceptible to many changes and variants, all falling within the scope of the inventive concept of the appended claims.

Furthermore, all construction details can be replaced by technically equivalent elements.

The invention claimed is:

1. A weft threads saving device for shuttle-less weaving machines suitable for making a fabric, said device being located and operating between a fabric-forming area which comprises a comb configured to beat the weft tails of the fabric and a temple configured to transversely stretch said fabric, said comb and said temple being positioned on an opposite side with respect to a cylinder configured to wrap the fabric, said weft threads saving device comprising a guiding plane for guiding said fabric, which is located downstream of said comb and of said temple, and a shear having a fixed blade, which is located below said fabric and downstream of said guiding plane, and a movable blade cooperating with said fixed blade, wherein said weft threads saving device also comprises:

- pneumatic and/or mechanical devices, configured for sliding said weft tails of the fabric onto said guiding plane and towards said fixed blade and said movable blade of said shear, thus maintaining said weft tails of the fabric protruding and extended;
- a suction system, positioned below said guiding plane and below said fixed blade of said shear, which is configured to recover excess weft tails of the fabric;
- wherein said saving device comprises at least two opposed strips placed in contact with the sides of said fabric, said strips having a front part placed next to said temple.

2. A weft threads saving device according to claim 1, wherein the distance between said at least two strips is progressively increasing along the cutting direction of said fixed and movable blades of said shear.

3. A weft threads saving device according to claim 1, wherein said at least two strips, between which the sides of the fabric run, are configured to push a plurality of said weft tails of the fabric between said strips and a guiding edge facing said strips.

4. A weft threads saving device according to claim 1, wherein in a spaced portion of said at least two strips, said weft tails are sucked by said suction system and brought close to said guiding plane, so that said weft tails are able to reach said fixed and movable blades of said shear.

5. A weft threads saving device according to claim 1, wherein said saving device comprises a first disk, which is carved in a radial pattern and sloped with respect to a vertical axis of rotation, said first disk leaning against at least a portion of said fabric.

6. A weft threads saving device according to claim 5, wherein said first disk is elastically connected with and placed opposite to a second disk.

7. A weft threads saving device according to claim 6, wherein said first and second disks rotate arranging said weft tails as a plurality of fringes, said weft tails running along said guiding plane and on said fixed blade of said shear, so that said fixed and movable blades of the shear are able to cut said excess weft tails of the fabric.

8. A weft threads saving device according to claim 5, wherein said first and second disks rotate arranging said weft tails as a plurality of fringes, said weft tails running along said guiding plane and on said fixed blade of said shear, so that said fixed and movable blades of the shear are able to cut said excess weft tails of the fabric.

9. A weft threads saving device according to claim 1, wherein said suction system comprises a suction nozzle made with a series of wrapped and superimposed layers with a spiral-shaped section, of which at least two layers are configured so that said fabric longitudinally slides and at least one third layer is configured to suck and prepare for cutting said weft tails, by means of at least one of said fixed and movable blades of the shear.

10. A weft threads saving device according to claim 9, wherein said suction nozzle is configured to maintain said weft tails in a mutually parallel position and in a position perpendicular to the edge of said fabric until said fabric (1) exits from said temple.

11. A weft threads saving device according to claim 10, wherein said suction nozzle uses said guiding plane as a support plane for an elastic gripping element, which is configured to grip the weft tails of said fabric, said weft tails sliding towards said fixed and movable blades of said shear.

12. A weft threads saving device according to claim 9, wherein said suction nozzle uses said guiding plane as a support plane for an elastic gripping element, which is configured to grip the weft tails of said fabric, said weft tails sliding towards said fixed and movable blades of said shear.

13. A weft threads saving device according to claim 12, wherein said suction nozzle, which is located downstream of said temple, is configured to suck said weft tails of the fabric which are previously cut by said fixed and movable blades of said shear, so that said weft tails are retrieved at an exit side of the fabric, by means of said elastic gripping element.

14. A weft threads saving device according to claim 11, wherein said suction nozzle, which is located downstream of said temple, is configured to suck said weft tails of the fabric which are previously cut by said fixed and movable blades of said shear, so that said weft tails are retrieved at an exit side of the fabric, by means of said elastic gripping element.

15. A weft threads saving device for shuttle-less weaving machines suitable for making a fabric, said device being located and operating between a fabric-forming area which comprises a comb configured to beat the weft tails of the fabric and a temple configured to transversely stretch said fabric, said comb and said temple being positioned on an opposite side with respect to a cylinder configured to wrap the fabric, said weft threads saving device comprising a guiding plane for guiding said fabric, which is located downstream of said comb and of said temple, and a shear having a fixed blade, which is located below said fabric and downstream of said guiding plane, and a movable blade cooperating with said fixed blade, wherein said weft threads saving device also comprises:

pneumatic and/or mechanical devices, configured for sliding said weft tails of the fabric onto said guiding plane and towards said fixed blade and said movable blade of said shear, thus maintaining said weft tails of the fabric protruding and extended;

a suction system, positioned below said guiding plane and below said fixed blade of said shear, which is configured to recover excess weft tails of the fabric;

wherein said at least two strips, between which the sides of the fabric run, are configured to push a plurality of said weft tails of the fabric between said strips and a guiding edge facing said strips.

16. A weft threads saving device for shuttle-less weaving machines suitable for making a fabric, said device being located and operating between a fabric-forming area which comprises a comb configured to beat the weft tails of the fabric and a temple configured to transversely stretch said fabric, said comb and said temple being positioned on an opposite side with respect to a cylinder configured to wrap the fabric, said weft threads saving device comprising a guiding plane for guiding said fabric, which is located downstream of said comb and of said temple, and a shear having a fixed blade, which is located below said fabric and downstream of said guiding plane, and a movable blade cooperating with said fixed blade, wherein said weft threads saving device also comprises:

pneumatic and/or mechanical devices, configured for sliding said weft tails of the fabric onto said guiding plane and towards said fixed blade and said movable blade of said shear, thus maintaining said weft tails of the fabric protruding and extended;

a suction system, positioned below said guiding plane and below said fixed blade of said shear, which is configured to recover excess weft tails of the fabric;

wherein in a spaced portion of said at least two strips, said weft tails are sucked by said suction system and brought close to said guiding plane, so that said weft tails are able to reach said fixed and movable blades of said shear.

17. A weft threads saving device for shuttle-less weaving machines suitable for making a fabric, said device being located and operating between a fabric-forming area which comprises a comb configured to beat the weft tails of the fabric and a temple configured to transversely stretch said fabric, said comb and said temple being positioned on an opposite side with respect to a cylinder configured to wrap the fabric, said weft threads saving device comprising a guiding plane for guiding said fabric, which is located downstream of said comb and of said temple, and a shear having a fixed blade, which is located below said fabric and downstream of said guiding plane, and a movable blade cooperating with said fixed blade, wherein said weft threads saving device also comprises:

pneumatic and/or mechanical devices, configured for sliding said weft tails of the fabric onto said guiding plane and towards said fixed blade and said movable blade of said shear, thus maintaining said weft tails of the fabric protruding and extended;

a suction system, positioned below said guiding plane and below said fixed blade of said shear, which is configured to recover excess weft tails of the fabric;

wherein said saving device comprises a first disk, which is carved in a radial pattern and sloped with respect to a vertical axis of rotation, said first disk leaning against at least a portion of said fabric.

18. A weft threads saving device for shuttle-less weaving machines suitable for making a fabric, said device being located and operating between a fabric-forming area which comprises a comb configured to beat the weft tails of the fabric and a temple configured to transversely stretch said fabric, said comb and said temple being positioned on an opposite side with respect to a cylinder configured to wrap the fabric, said weft threads saving device comprising a guiding plane for guiding said fabric, which is located downstream of said comb and of said temple, and a shear having a fixed blade, which is located below said fabric and downstream of said guiding plane, and a movable blade cooperating with said fixed blade, wherein said weft threads saving device also comprises:

pneumatic and/or mechanical devices, configured for sliding said weft tails of the fabric onto said guiding plane and towards said fixed blade and said movable blade of said shear, thus maintaining said weft tails of the fabric protruding and extended;

a suction system, positioned below said guiding plane and below said fixed blade of said shear, which is configured to recover excess weft tails of the fabric;

wherein said suction system comprises a suction nozzle made with a series of wrapped and superimposed layers with a spiral-shaped section, of which at least two layers are configured so that said fabric longitudinally slides and at least one third layer is configured to suck and prepare for cutting said weft tails, by means of at least one of said fixed and movable blades of the shear.

* * * * *